US005540036A

United States Patent [19]

Scroggin et al.

[11] Patent Number: 5,540,036

[45] Date of Patent: Jul. 30, 1996

[54] VARIABLE PITCH ESCAPEMENT FOR ARTICLE INFEED IN PACKAGING MACHINE

[75] Inventors: Daniel J. Scroggin, Portland; John L. Raudat, Madison, both of Conn.

[73] Assignee: Standard-Knapp, Inc., Portland, Conn.

[21] Appl. No.: 338,020

[22] Filed: Nov. 10, 1994

[51] Int. Cl.[6] ..... B65B 35/30

[52] U.S. Cl. ..... 53/543; 53/157; 53/48.1; 198/419.2

[58] Field of Search ..... 53/157, 543, 48.1; 198/419.2, 419.3, 426, 473.1, 425, 461

[56] References Cited

U.S. PATENT DOCUMENTS

| | | | |
|---|---|---|---|
| 3,872,647 | 3/1975 | Langen et al. | 53/157 |
| 4,637,509 | 1/1987 | Raudat et al. | 198/425 |
| 4,642,967 | 2/1987 | Culpepper | 198/425 |
| 4,832,178 | 5/1989 | Anderson et al. | 198/419.3 |
| 4,962,625 | 10/1990 | Johnson, Jr. et al. | 53/543 |
| 5,056,298 | 10/1991 | Deadmond | 53/543 |
| 5,201,823 | 4/1993 | Pazdernik | 198/419.3 |

FOREIGN PATENT DOCUMENTS

| | | | |
|---|---|---|---|
| 2131383 | 6/1984 | United Kingdom | 198/419.3 |

*Primary Examiner*—John Sipos
*Assistant Examiner*—Ed Tolan
*Attorney, Agent, or Firm*—McCormick, Paulding & Huber

[57] ABSTRACT

In a packaging machine the articles to be packaged are handled by escapement means that generate gaps between successive articles in each column. The escapement means includes at least two pin conveyors, each of which is driven at a speed which is controlled whereby to permit varying the pitch distance between the pins of each of these two conveyors in order to accommodate a different number of and differently sized articles. The articles are separated by a take away conveyor driven at a slightly greater speed than the pin conveyors to create gaps between the adjacent rows of articles. Partitions may be fed into these gaps, and other gaps are used to permit entry of a flight bar grouper conveyor that ultimately groups the articles so as to create a desired pack pattern for loading.

9 Claims, 6 Drawing Sheets

VARIABLE PITCH ESCAPEMENT FOR ARTICLE INFEED IN PACKAGING MACHINE

BACKGROUND OF THE INVENTION

The present invention relates to packaging machines of the type adapted to handle articles fed continuously by line pressure in a downstream direction into the machine where groups of the articles can be mated with individual trays. More specifically, the present invention relates to a unique escapement means capable of creating gaps between adjacent rows of articles as the articles move in columns in a downstream direction. The articles are then grouped for delivery into a load station.

DESCRIPTION OF THE PRIOR ART

Packaging machines of the type adapted to pack groups of articles in trays or the like, where the articles move continuously in a downstream direction through a load station, generally include means for grouping the articles so that these groups can be loaded on individual trays or cases.

Such continuous motion high speed tray loading machines must be shut down for change-over to loading articles of different size. These shut down times interfere with orderly production schedules, and can require rather extensive re-working of the complicated grouping devices commonly provided in such packaging machines generally.

SUMMARY OF THE INVENTION

The general purpose of the present invention is to provide a variable pitch escapement and grouping mechanism for the article infeed to such a packaging machine wherein the line pressure is controlled by the variable pitch escapement and each row of articles is separated from an adjacent row as the articles move in columns downstream toward the load station. The individual rows so segregated can be conveniently fitted with partitions in the gaps therebetween. A more important result however is that provision is made for an overrunning flight bar or grouper conveyor that compresses any convenient number of segregated article rows to form groups of desired size so that the groups can be provided on individual trays or in individual packing cases at the load station.

The present invention accomplishes these objects by providing a packaging machine with lane guides for handling columns of generally cylindrical upright articles as they advance by line pressure into the upstream end of the packaging machine. The escapement means holds back the columns of articles and releases the articles row on row at a controlled rate. The escapement means includes two congruent pin conveyors, one of which pin conveyors has its pins driven at a substantially constant speed somewhat slower than the speed of the infeed conveyor 16. The articles slip relative to the conveyor chain and their resulting traction against the chain cause sufficient line pressure to prevent gaps in the rows while the rows are controlled by the escapement. The other of said two pin conveyors has its pins driven at a controlled speed that varies cyclically in order to match the speed of said first pin conveyor only during movement of all the pins along upper runs of these conveyors where the pins are spaced at a pitch dimension that is thereby kept within a predetermined range. The predetermined pitch dimension range allows the pitch to be varied to accommodate articles of different size. In fact, pitch distance can be varied to accommodate different numbers of articles so that the range of pitch dimensions can be kept within a reasonable range, and nevertheless accommodate articles of significantly different diameters.

Another feature of the present invention relates to the capability for varying the lateral spacing between the lane guide to accommodate these differently sized articles. The lateral adjustment made to the lane guides also achieves corresponding adjustment to the spacing between the pins on each of the two pin conveyors.

Still another feature of the present invention can be attributed to the fact that the articles are aligned laterally as they move in columns by the pin conveyors, and the pin conveyors achieve separation or gaps between adjacent article rows so that partitions can be conveniently inserted between certain of these article rows within each of the ultimately formed groups of articles to be loaded on a particular tray or in a particular packing case.

Finally, the pin conveyors are driven by motors that are computer controlled so that the speed of at least one and preferably both pin conveyors can be varied within each cycle. This capability permits the pins to remain vertical as they move upwardly between the adjacent cylindrical articles and associated lane guides. Each pin conveyor runs on an endless chain which moves in a sloped path as the pins move upwardly into the spaces between adjacent articles, and also as these pins move out of such spaces at the ends of their upper runs. During the return runs of at least one of the pin conveyor chains, adjustments are made to the chain speed so that the desired pitch distance between the pins can be maintained during their active or upper runs. A downstream flight bar conveyor system is provided to subsequently group the articles as required for loading article groups of desired pack pattern on trays or in packing cases.

BRIEF DESCRIPTION OF THE DRAWINGS

A more complete understanding of the invention and many of the advantages thereto will be readily appreciated as the same becomes better understood by reference to the following detailed description when considered in conjunction with the accompanying drawings wherein.

DETAILED DESCRIPTION OF THE PREFERRED EMBODIMENT

Figure 1:
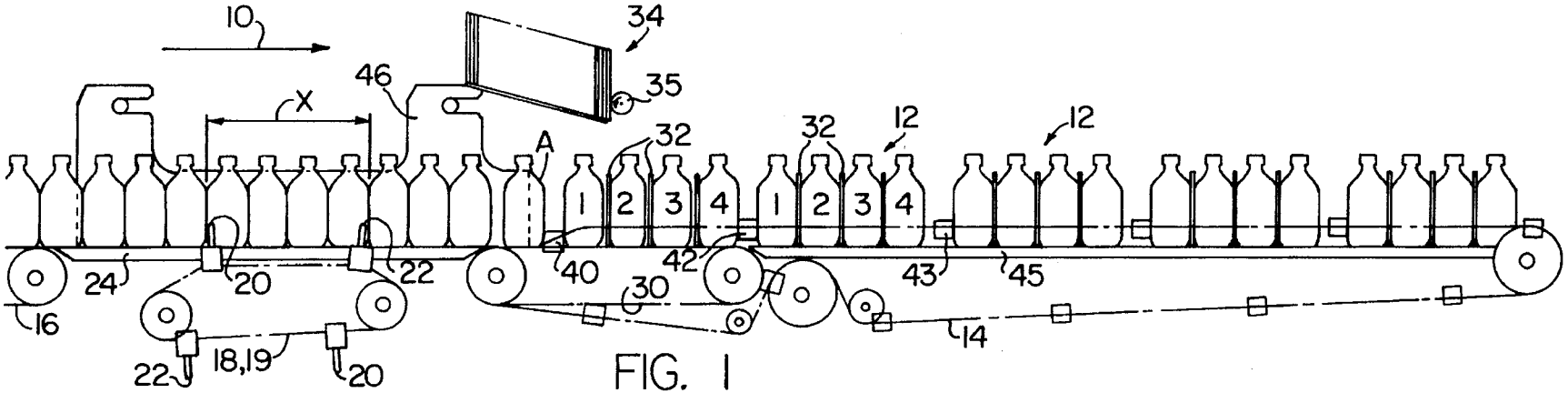
FIG. 1 is a side elevational view illustrating in schematic fashion an escapement incorporating the present invention.

Turning now to the drawings in greater detail, FIG. 1 shows a portion of a packaging machine that is suitable for use in packaging articles fed continuously by line pressure from an infeed conveyor 16 in a downstream direction, as indicated by the arrow 10, toward the load station of the machine where groups of the articles, such as suggested at 12, are mated with an upwardly open tray or packing case (not shown).

These grouped articles 12,12 are advanced on a dead plate 45 by the flight bar conveyor 14 and grouped in a pack pattern for a particular tray configuration.

Figure 2:
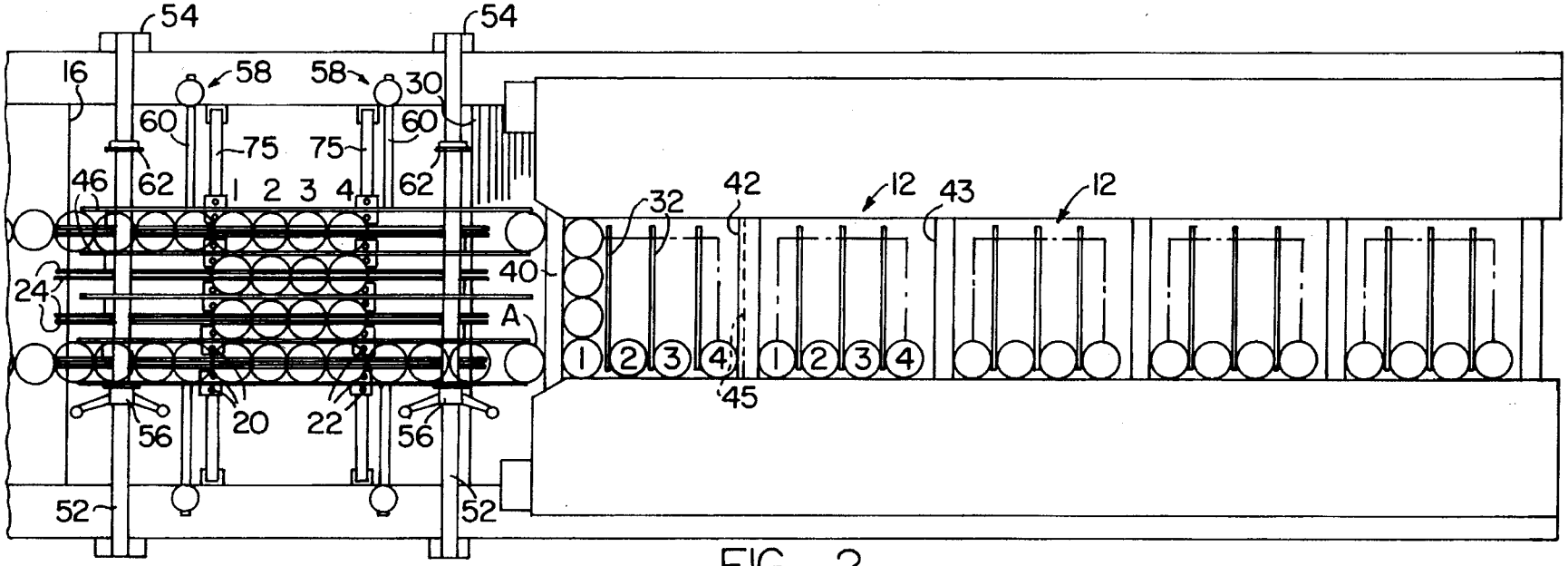
FIG. 2 is a plan view of the schematically illustrated apparatus of FIG. 1.

The infeed conveyor 16 operates continuously at a speed that advances these articles between lane guides 46,46 to provide one or more columns of articles as shown in FIG. 2. The articles are aligned in laterally extending rows by operation of an escapement mechanism to be described.

Only one column of articles is shown in FIG. 1 to present in schematic fashion the operation of the escapement mechanism. Two pin conveyor chains 18,19 operate two sets of pins 20 and 22 so that upper runs of both conveyor chains travel in a downstream direction at a speed somewhat slower than the speed of the overrunning infeed conveyor 16. The pins 20 on one conveyor 18 slow the advancing articles to the speed of the pin conveyor 18. The second pin conveyor 19 arranged in congruent fashion with the first conveyor 18 carries a second set of pins 22, one of which is shown between adjacent articles at the downstream end of the four adjacent articles (1,2,3,4) and dictates a particular pitch distance X defined by the diameter of each article multiplied by the number (four) of such articles.

Riding strips, or dead plate rails 24 are provided for each column of articles between the pins, for supporting the articles as they move through the escapement pin conveyors 18,19 that drive the pins 20 and 22 respectively.

A higher speed take away conveyor 30 is provided downstream of the riding strips 24, and serves to create a gap between the adjacent rows of articles so as to provide a number of rows (1, 2, 3 and 4 in FIG. 1) on this take away conveyor 30. The gaps between the adjacent articles are utilized to insert partitions 32,32 from a magazine 34. Each partition is driven downwardly into a gap on the fly by suitable partition inserting means such as indicated generally at 35 in FIG. 1.

Since the groups 12,12 of articles to be formed for mating with the trays at the load station (not shown) have four rows of articles that comprise the group, means is provided for introducing a flight bar 40 of the flight bar conveyor 14 into the gap between article 1 and the next following article A that is pushed along by one or the other of pins 20 and 22 associated with the escapement device. Thus, the flight bars 40 and 42 are provided one on either side of a prospective group of articles to be packaged. Further downstream a flight bar 43 moves the four rows of articles (1, 2, 3 and 4) downstream to the load station (not shown). The flight bar 42 of conveyor 30 moves the next group 12 across a dead plate 45 where the flight bar 42 serves to compact or bring together the four rows of articles (1, 2, 3 and 4) so as to form an appropriately sized group for handling at the load station. The flight bar conveyor 14 performs the grouping function required for creating the desired pack pattern.

FIG. 2 is a top plan view of the schematically illustrated apparatus of FIG. 1, and shows four laterally aligned columns of articles being handled by the pins of the escapement pin conveyors described above. Laterally spaced lane guides 46,46 are provided over the infeed conveyor 16, and along the entire length of the riding strip 24 associated with these pin conveyors 18,19 and their associated pins 20 and 22.

Still with reference to FIG. 2, the pack pattern or grouping of articles in the rows (1, 2, 3 and 4) is carried out by providing the take away conveyor 30 in the form of a belt that moves each row of article in turn away from the endmost row of articles A on the riding strips 24 associated with the pin conveyors 20 and 22. This take away conveyor 30 preferably comprises a series of laterally extending slats as shown, and it is a feature of the present invention that the upstream end of the conveyor 30 will accommodate the flight bars 40,42,43 as each flight bar moves upwardly over the top of the take away conveyor 30. As so constructed and arranged the flight bar 42 ultimately contacts the upstream row 1 moving it into contact with the next row 2 and finally into contact with the leading row 4 so as to form the desired pack pattern or group as described previously.

It is an important feature of the present invention that gaps are formed between successive rows of article on the take away conveyor 30, and as a result of this capability the pitch distance X between the pins 20 and 22 of the respective pin conveyors need be varied only slightly to accommodate articles of quite different diameter.

Figure 3:
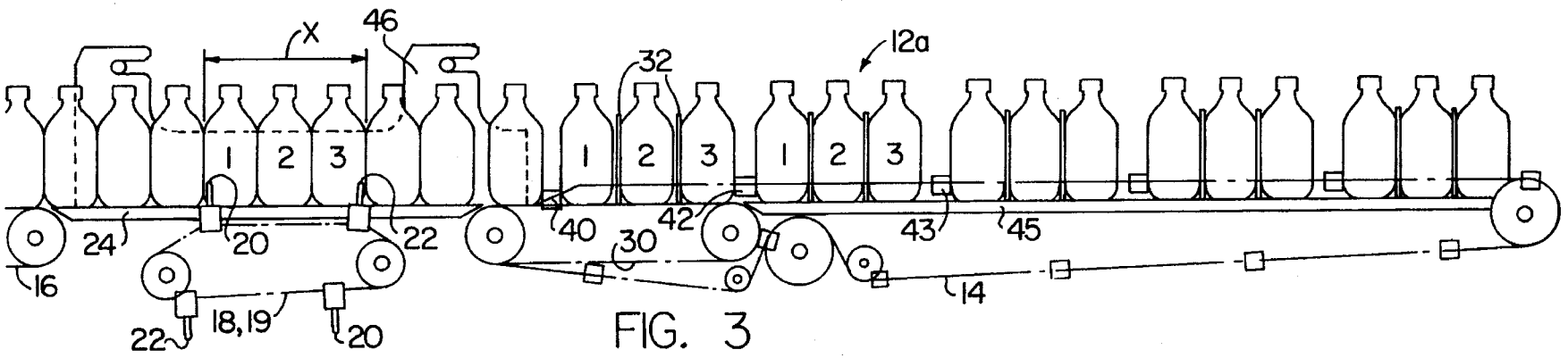
FIG. 3 is a schematic view of the apparatus illustrated in FIG. 1 showing the capability for handling objects of somewhat larger size by reducing the number of rows handled by this novel escapement.

Referring now to FIG. 3, it will apparent that the pin conveyor escapement device is capable of accommodating three rows of articles (1, 2 and 3), which articles are of somewhat greater diameter than the articles referred to previously by reference to FIGS. (1 and 2). The articles of FIG. 3 can be grouped in any convenient number, as for example three rows as illustrated at **12*a* in FIG. 3. Note that the take away conveyor 30 operates at a slightly greater speed than that of the escapement pin conveyors with the result that gaps are created between the adjacent rows on the take away conveyor 30. The over running flight bar conveyor 14 will cooperate with the take away conveyor 30 and ultimately compress the rows of articles on the dead plate 45** in groups of appropriate pack pattern size.

Figure 4:
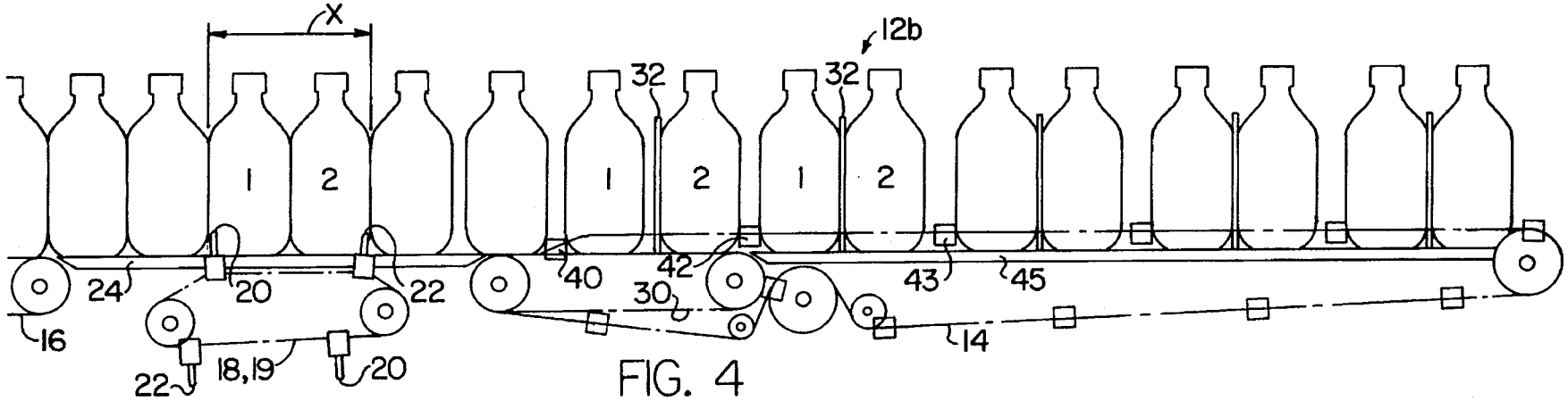
FIG. 4 is a view similar to FIG. 3 illustrating the same apparatus in the process of handling objects of even larger size.

FIG. 4 illustrates the same apparatus as depicted in FIG. 3 but with even larger diameter articles. The pitch distance X in the case of such large articles can be conveniently adjusted to accommodate two such articles rather than three or four as described above with reference to FIGS. 1 and 3. FIG. 4 also illustrates the gaps formed between the adjacent rows of articles (1 and 2) and the gap provided for the flight bar 40 which will ultimately compress the rows (1 and 2) for purposes of packing the articles at the load station in groups as suggested at **12*b* in FIG. 4**.

Figure 5:
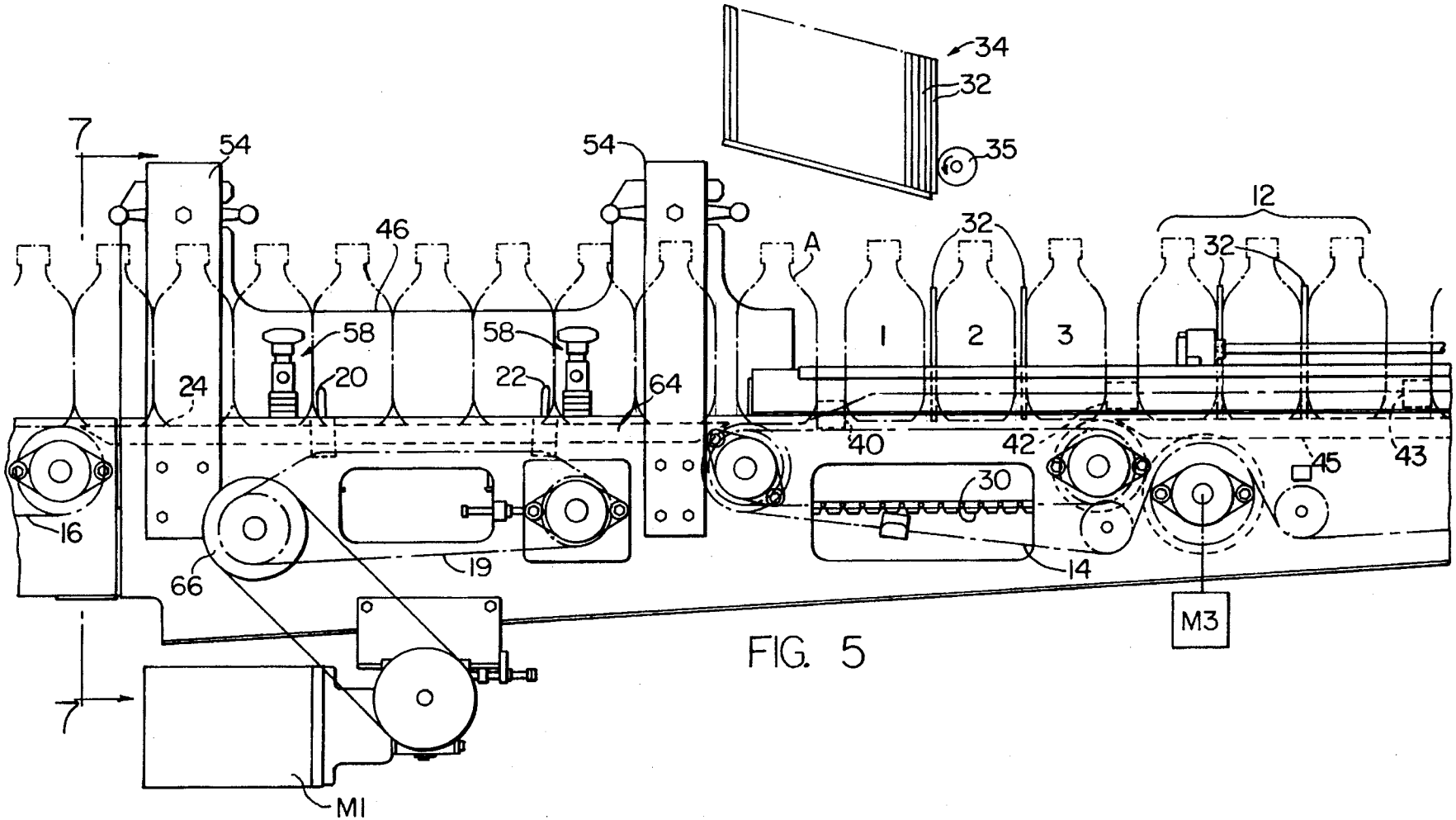
FIG. 5 is an elevational view illustrating in more detail the escapement apparatus of FIGS. 1–4, the apparatus shown being set up for handling columns of articles to be packaged three rows to a case or tray.
Figure 6:
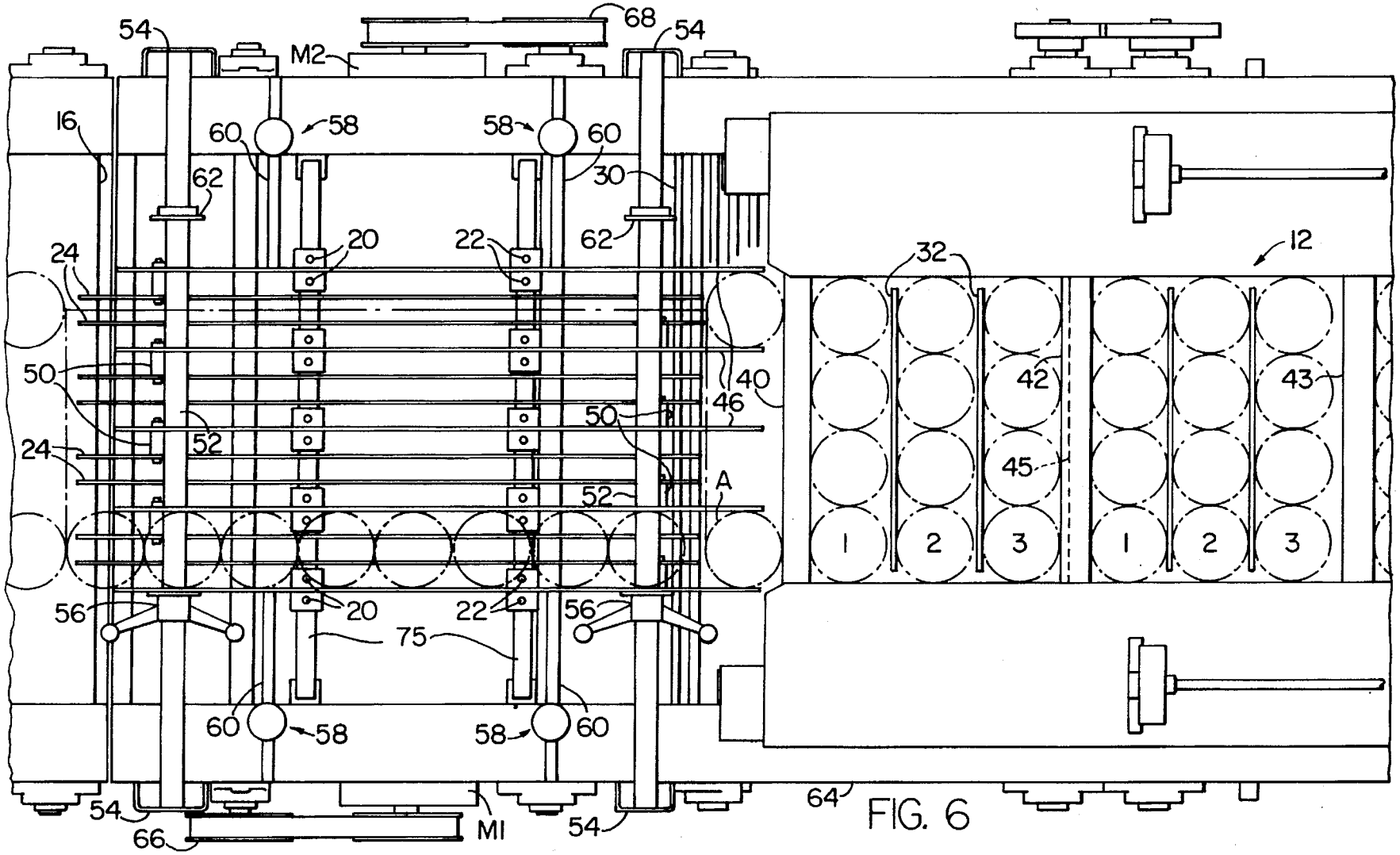
FIG. 6 is a top plan view of FIG. 5.

Turning now to a more detailed description of the apparatus referred to schematically in FIGS. 1–4, FIGS. 5–8 inclusively illustrate in detail the escapement pin conveyor configuration that cooperates with the take away conveyor 30 and the flight bar conveyor 14. FIG. 5 shows the articles entering by line pressure between lane guides 46 onto the upstream end of the riding strips 24. FIG. 6 shows this riding strip 24 as comprising a plurality of longitudinally extending pairs of rails 24,24 each of which is supported from one of the lane guides 46 by laterally extending posts 50,50. These posts are provided at adjacent upstream and downstream ends of the riding strips 24, and are supported directly from the lane guides 46. As a result of this construction, lateral adjustment of the lane guides 46,46 to accommodate articles of different diameter also achieves adjusting movement of the riding strips 24. As shown in FIG. 6 the lane guides 46 are supported from threaded cross shafts 52,52 in conventional fashion. The ends of each cross shaft 52,52 are supported in upright stanchions as best shown in FIG. 5 at 54,54 and the threaded nuts 56,56 allow horizontal or lateral clamping of the lane guides in a range of positions such that the spacing between them can be varied to accommodate articles of different diameter.

The outside lane guides are located against a stop structure illustrated generally at 58. A vertically extending post is provided in the frame of the machine to support a laterally extending stop guide 60. A stop nut 62 may be provided on the threaded rod 52 generally opposite the threaded hand nut 56 in order to define the maximum lateral spacing accommodated in the machine for a particular size and number of columns of articles.

Figure 7:
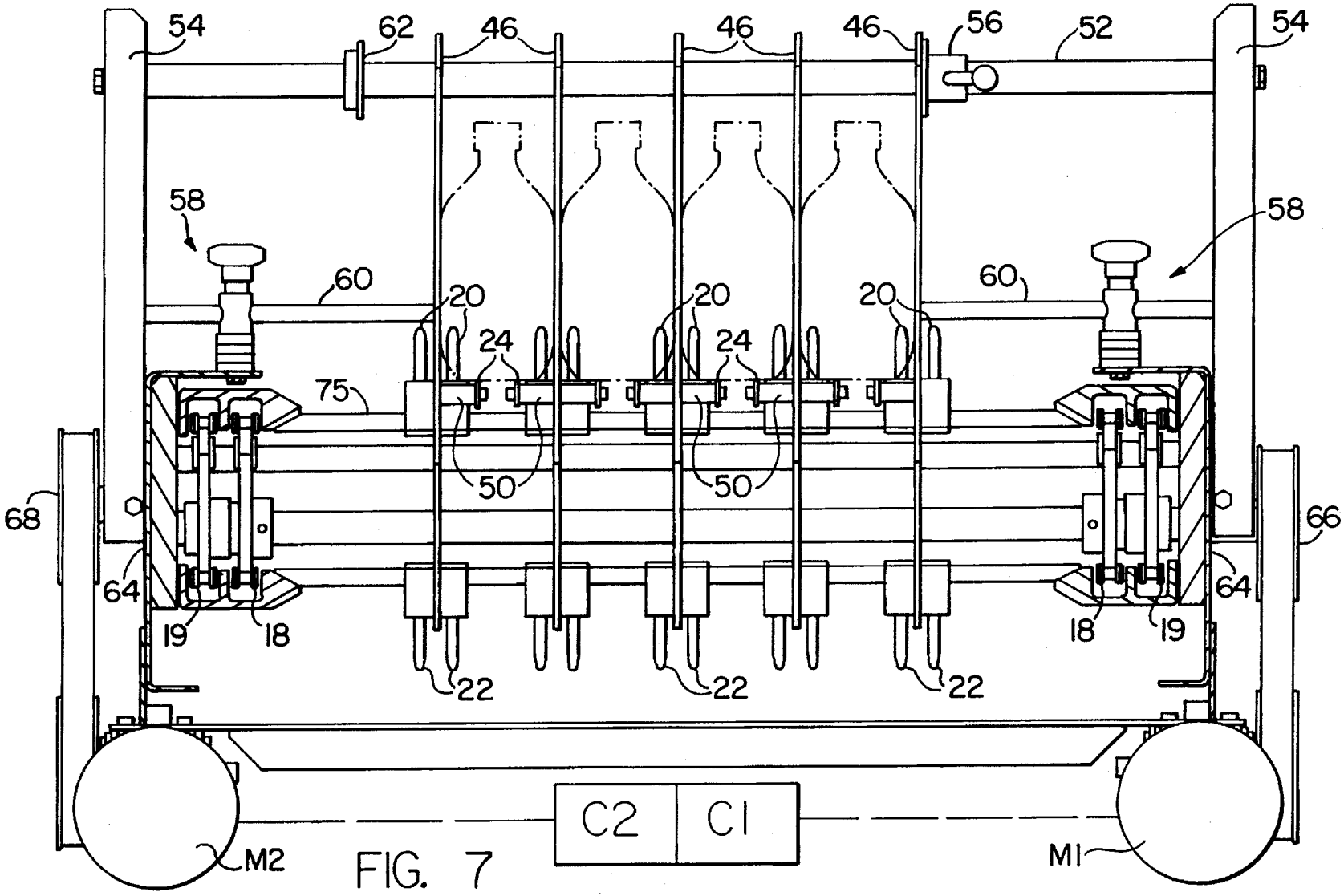
FIG. 7 is a vertical section taken generally on line 7—7 of FIG. 5.

Still with reference to FIG. 7, the longitudinally extending riding strips 24,24 are shown supported on the posts 50. The upright stanchions 54,54 that carry the threaded cross shafts 52 are supported at the lower ends in channel shaped side frame members 64,64. The side frame members 64,64 are channel shaped and define inwardly open cavities that support the first and second pin conveyor chains. These pin conveyor chains are arranged in sets or pairs as shown generally at 18,18 and 19,19. Each conveyor chain set is independently driven by an associated motor M1 and M2 respectively. A drive sprocket 66 is associated with the motor M1 and the drive sprocket 68 being associated with the other motor M2 for purposes of driving these pin conveyor chain sets. Thus, each pin conveyor comprises a set of laterally spaced chains, and it is a feature of the present invention that these laterally spaced chains are driven at different speeds over congruent paths so that the pins associated with each pin conveyor can be independently driven. This feature allows the pitch distance X referred to previously to be conveniently varied so that the pins associated with each pin conveyor can travel at substantially the same speed during their active or upper runs where they are received between the adjacent rows of articles. Any make up in speed is accommodated by the return run of the pin conveyor chains illustrated at the lower portion of FIG. 8, for example. The motors M1 and M2 are preferably motors driven by a programmable computer represented schematically by controllers C2 and C1 as shown in FIG. 7. These controllers C2 and C1 associated with the motors M1 and M2 respectively permit the speed of both motors to be repeatably controllable, preferably by a programmable computer in accordance with well known techniques. Thus, each pin conveyor 18 and 19 and its associated pins 20 and 22 can be driven at individually controlled speeds.

Figure 8:
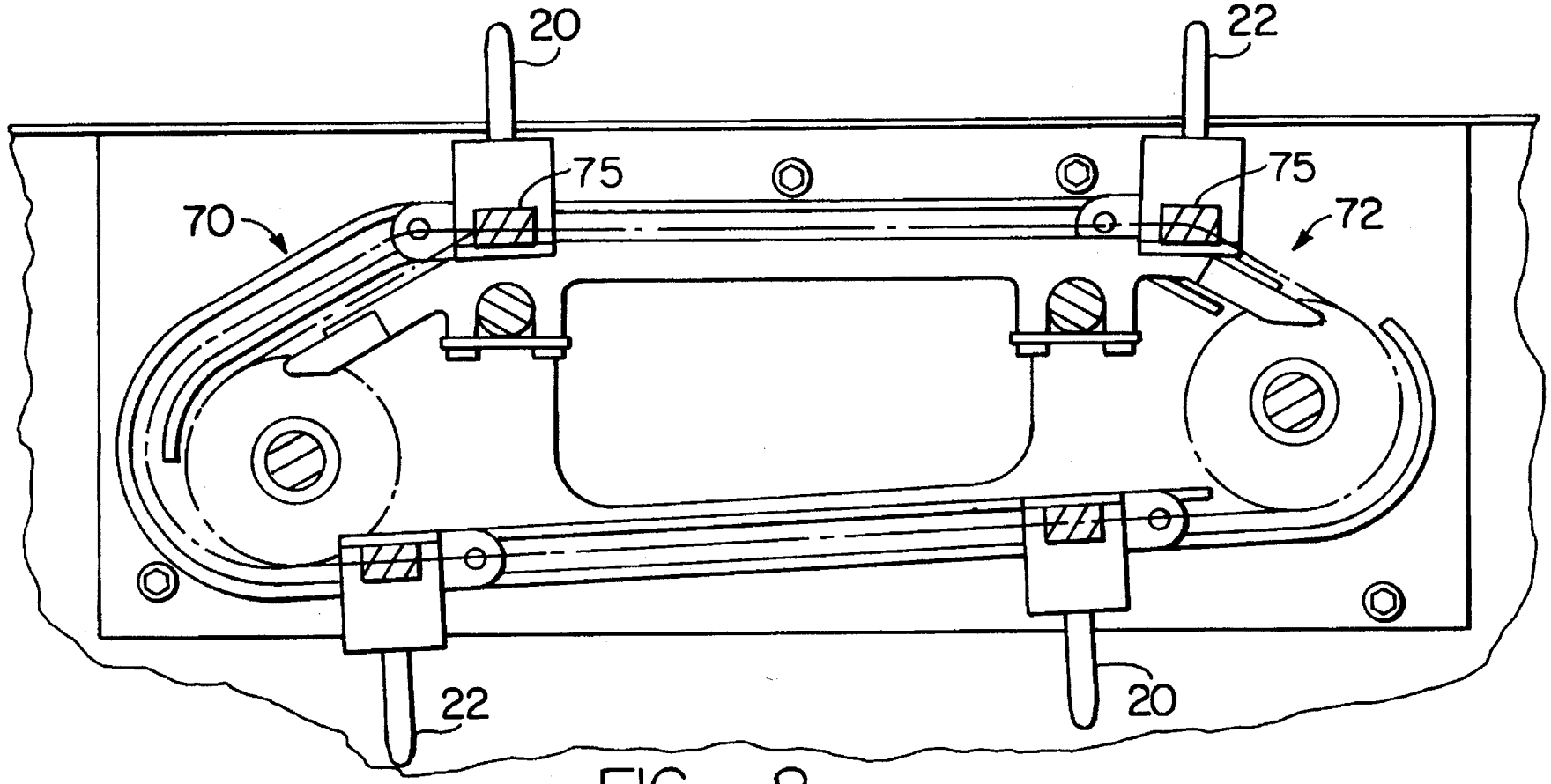
FIG. 8 is a detailed view of the escapement chain conveyors and is taken in elevation, omitting the supporting structure, so as to reveal the path for the chains and associated tie bars and pins.

Preferably, each one of these pin conveyors is kept at constant horizontal speed while it moves up the ramp 70 of the cam path along the upper flat section and down the ramp 72. The motors make speed corrections, during the pin travel up ramp 70 and down ramp 72, such that the horizontal speed remains constant. FIG. 8 also shows the camming mechanism that maintains the vertical orientation for the pins 20 and 22 as the pins move upwardly along the ramp 70 into the space provided between the containers, and subsequently move downwardly out of that space in the ramp area 72. The term "constant" speed provided for at least one of the pin conveyors is intended to convey the concept that the horizontal component of motion of the pins 20 and 22 in the ramp areas 70 and 72 will correspond very closely to the linear speed of the pins as they travel in parallel along the same path as the articles on the riding strips 24,24 as described previously. Thus, the entry point at which the pins penetrate the plane defined by these riding strips 24 can be varied in time to accommodate articles of different size and different number, all as referred to previously with reference to FIGS. 1–4 inclusively.

It is an important feature of the present invention that the pins are themselves arranged in pairs within each pin conveyor chain circuit, and as best shown in FIG. 7 each pair of pins is provided one on either side of a lane guide 46. These paired pins are provided on blocks that are slidably supported on pin bars 75,75 associated with one or the other of the two pin conveyor chains. Each block is slotted for receiving a lane guide to couple them for movement with one another. As so constructed and arranged lateral adjustments to the locations for lane guides 46,46, to accommodate articles of different size, will also achieve corresponding adjustment between the respective pairs of pins. These pins are slidably mounted on the pin bars 75,75 of each of the two pin conveyor systems for this purpose.

Turning next to a more detailed description of the take away belt conveyor 30 and the associated flight bar conveyor 14, FIG. 5 illustrates the belt conveyor 30 as comprising a plurality of laterally extending plates, and shows the upper run or path of this conveyor 30 as common with a portion of the path of the flight bar conveyor 14. Note that the flight bar 40 follows the upper run of the take away conveyor 30 for at least a short distance adjacent the upstream end thereof, after which it will ramp upwardly as illustrated at 15 in FIG. 5. It is this upward ramp on the flight bar conveyor 14 that moves the flight bar 40 into a gap between adjacent article rows as provided for this purpose. Other gaps provided for by the take away conveyor 30 may be fitted with partitions as shown in FIG. 5, each partition being indicated generally at 32 in this view. The mechanism for inserting the partitions 32 preferably operated in synchronism with the flight bar conveyor 14. A motor M3 drives the flight bar conveyor 14 and the partitions are fed from the magazine 34 containing a plurality of such partitions by conventional means, such as illustrated schematically at 35 in FIG. 5.

The flight bar conveyor 14 has its flights 40 and 42 etc. so spaced that as the articles are moved off the belt conveyor 30 onto the dead plate 45 they are compressed into predetermined groups (in this case each column has three articles for example). Thus, escapement means of the present invention combined with this grouping feature permits pack patterns of various configurations to be achieved.

We claim:

1. A machine for handling columns of generally cylindrical upright articles advancing into a packaging machine that includes a downstream station where groups of the articles are loaded into cases or trays, the improvement comprising:

a continuously operating infeed conveyor and associated deadplate downstream thereof;

article escapement means for controlling the columns of articles on said deadplate and releasing these articles at a controlled rate;

a first article conveyor downstream of said deadplate receiving the articles as they are released by said escapement means, said first article conveyor being driven at a speed such that each row of articles is accelerated away from the next succeeding row to create gaps between adjacent articles in each column on said first article conveyor and on said deadplate;

a grouper conveyor having groupers that move into certain of said gaps between said columns of articles, said grouper conveyor being driven at substantially the same speed as said first article conveyor for sweeping groups of successive article rows together for loading, said escapement means including two pin conveyors, a first of said two pin conveyors having first pins driven at a substantially constant speed somewhat slower than the speed of said first article conveyor, and a second of said two pin conveyors having second pins driven at a controlled speed that varies cyclically to match the constant speed of said first pin conveyor during movement of all said first and second pins of said two pin conveyors along upper runs wherein said first pins have a predetermined pitch dimension as between one another, said second pins having speed variations limited to travel of said second pins in a return direction below said deadplate, whereby said first and second pins engage the articles to hold back the articles as aforesaid, and whereby articles of different diameters can be accommodated within a range of pitch distances that is not dictated by the diameter of the articles being handled.

2. The combination according to claim 1, wherein said improvement further comprises lane guides for laterally restraining the articles traveling through said escapement means to movement downstream between said lane guides, said lane guides defining a plurality of article columns, and said articles also being arranged laterally aligned in rows by said escapement means.

3. The combination according to claim 1, wherein said improvement is further characterized by partition inserting means provided adjacent the first article conveyor to insert partitions into other of said gaps between adjacent articles, said partition inserting means providing partitions between adjacent article rows within a group of articles to be loaded.

4. The combination according to claim 3, wherein said improvement further comprises lane guides for laterally restraining the articles traveling through said escapement means to movement downstream between said lane guides, and means for varying the lateral spacing between said lane guides to accommodate articles of different diameters.

5. The combination according to claim 2, wherein at least the second of said two pin conveyors comprises laterally spaced endless chains, and pin bars extending laterally across the space between said chains, said chains and pin bars moving in a closed circuit, said pins of said second pin conveyor provided slidably on said pin bars and being located laterally of and coupled to said lane guides whereby said means for varying said lateral spacing between said lane guides also varies the lateral spacing between said pins of said other pin conveyor.

6. The combination according to of claim 5, further characterized by a motor drive means for said second pin conveyor, and control means for said second pin conveyor motor drive means to provide a speed for said pins of said second conveyor that matches the speed of said first pin conveyor during movement in said downstream direction, said second pin conveyor speed being varied during movement in its return or upstream direction when the second pins are not in contact with the articles whereby different pitch distances for said first and second pins can be achieved.

7. The combination according to claim 5, wherein both said first and said second pin conveyor includes generally congruent laterally spaced endless chains each having horizontal upper runs for said chains and camming means for acting upon said first and second pins to move said first and second pins generally vertically into the spaces between adjacent cylindrical articles and alongside said lane guides, and a drive means for said first pin conveyor, said first and said other pin conveyor drive means providing speed components for the first and second pins that are subjected to said camming means such that the speed of all said first and second pins moving in said horizontal downstream direction can be kept nearly constant, the speed of the first and second pin conveyor chains being increased or decreased as they return in the upstream direction as required to maintain the predetermined pitch distance required for the number of and diameter of articles being handled.

8. The combination according to claim 7, wherein said deadplate comprising dead plate rails provided to support the articles being handled by said escapement means, and wherein said dead plate support rails are also supported from said lane guides.

9. The combination according to claim 7 wherein said first and second pins so moved by said camming means have substantially constant horizontal speed components as they are acted upon by said camming means and as they travel horizontally along said upper runs.

* * * * *

UNITED STATES PATENT AND TRADEMARK OFFICE

CERTIFICATE OF CORRECTION

PATENT NO. : 5,540,036

DATED : July 30, 1996

INVENTOR(S) : Scroggin et al.

It is certified that error appears in the above-identified patent and that said Letters Patent is hereby corrected as shown below:

Column 8, line 19, (claim 7), the word "other" should be --second--.

Signed and Sealed this

Nineteenth Day of November, 1996

*Attest:*

Bruce Lehman

BRUCE LEHMAN

*Attesting Officer*

*Commissioner of Patents and Trademarks*